US006749541B1

(12) United States Patent
Martin

(10) Patent No.: US 6,749,541 B1
(45) Date of Patent: Jun. 15, 2004

(54) FOOT STRAIGHTENING TRAINER APPARATUS

(76) Inventor: Ellis G. Martin, 4701 Banner St., Hyattsville, MD (US) 20781

( * ) Notice: Subject to any disclaimer, the term of this patent is extended or adjusted under 35 U.S.C. 154(b) by 295 days.

(21) Appl. No.: 10/074,430

(22) Filed: Feb. 20, 2002

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,312,310 A * 5/1994 Shimizu et al. ..... 482/54
6,162,151 A * 12/2000 Tani et al. ..... 482/54
6,179,754 B1 * 1/2001 Wang et al. ..... 482/54

* cited by examiner

*Primary Examiner*—Glenn E. Richman

(57) ABSTRACT

A foot straightening trainer apparatus for helping to correctly align or straighten pigeon-toed and penguin-toed feet of users. The foot straightening trainer apparatus includes a base assembly including an elongate housing having top and side walls, and also including rollers being spaced apart and being disposed in the elongate housing, and further including an endless belt having a selected width and being carried about the rollers and being movable upon the top wall, and also having a motor being connected to at least one of the rollers; and also includes a handrail assembly being attached to the elongate housing and extending upwardly therefrom for a user to hold while walking upon the endless belt; and further includes a first switch member being attached to the handrail assembly for energizing the motor to drive the endless belt; and further includes a sensor/alarm assembly for detecting improper foot alignment and for signaling to the user of the detection of the improper foot alignment.

7 Claims, 5 Drawing Sheets

FOOT STRAIGHTENING TRAINER APPARATUS

BACKGROUND OF THE INVENTION

1. Field of the Invention

The present invention relates to foot straightening trainers and more particularly pertains to a new foot straightening trainer apparatus for helping to correctly align or straighten pigeon-toed and penguin-toed feet of users.

2. Description of the Prior Art

The use of foot straightening trainers is known in the prior art. More specifically, foot straightening trainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,135,924; 5,800,314; 4,708,337; 3,924,615; 5,314,391; and Des. 421,779.

While these devices fulfill their respective, particular objectives and requirements, the aforementioned patents do not disclose a new foot straightening trainer apparatus. The prior art describes conventional treadmills used for exercising purposes.

SUMMARY OF THE INVENTION

The general purpose of the present invention, which will be described subsequently in greater detail, is to provide a new foot straightening trainer apparatus which has many of the advantages of the foot straightening trainers mentioned heretofore and many novel features that result in a new foot straightening trainer apparatus which is not anticipated, rendered obvious, suggested, or even implied by any of the prior art foot straightening trainers, either alone or in any combination thereof. The present invention includes a base assembly including an elongate housing having top and side walls, and also including rollers being spaced apart and being disposed in the elongate housing, and further including an endless belt having a selected width and being carried about the rollers and being movable upon the top wall, and also having a motor being connected to at least one of the rollers; and also includes a handrail assembly being attached to the elongate housing and extending upwardly therefrom for a user to hold while walking upon the endless belt; and further includes a first switch member being attached to the handrail assembly for energizing the motor to drive the endless belt; and further includes a sensor/alarm assembly for detecting improper foot alignment and for signaling to the user of the detection of the improper foot alignment. None of the prior art describes inventions comprising a conventional treadmill with light-emitting members, light-receiving sensors, and sound-producing members being used to train and correct the feet alignment of a user.

There has thus been outlined, rather broadly, the more important features of the foot straightening trainer apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new foot straightening trainer apparatus which has many of the advantages of the foot straightening trainers mentioned heretofore and many novel features that result in a new foot straightening trainer apparatus which is not anticipated, rendered obvious, suggested, or even implied by any of the prior art foot straightening trainers, either alone or in any combination thereof.

Still another object of the present invention is to provide a new foot straightening trainer apparatus for helping to correctly align or straighten pigeon-toed and penguin-toed feet of users.

Still yet another object of the present invention is to provide a new foot straightening trainer apparatus that is easy and convenient to use.

Even still another object of the present invention is to provide a new foot straightening trainer apparatus that helps the user to exercise the muscles of one's feet to correctly align and point one's feet in the direction of forward movement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
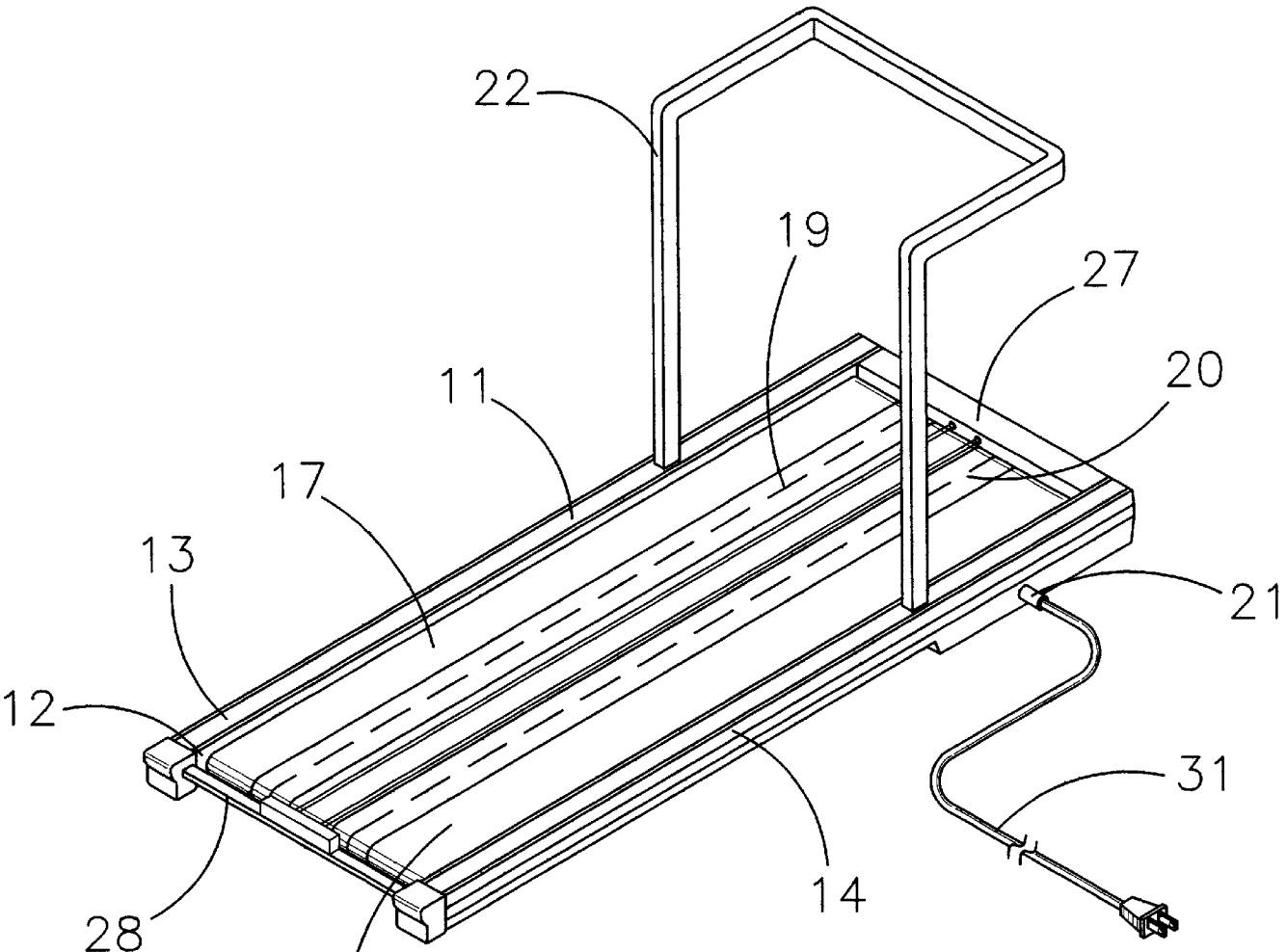
FIG. 1 is a perspective view of a new foot straightening trainer apparatus according to the present invention and shown in use.
Figure 2:
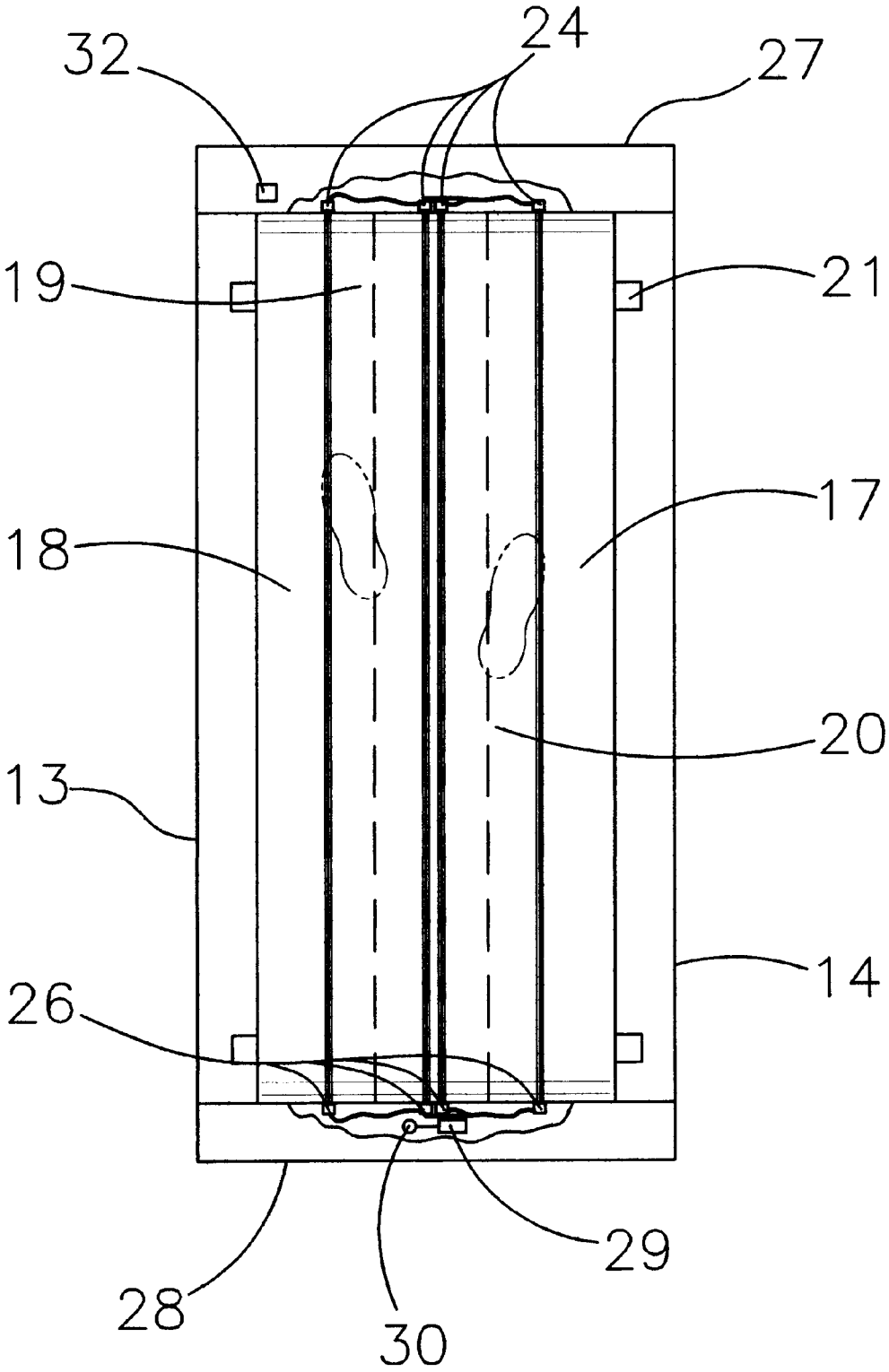
FIG. 2 is a top plan view of the present invention.
Figure 3:
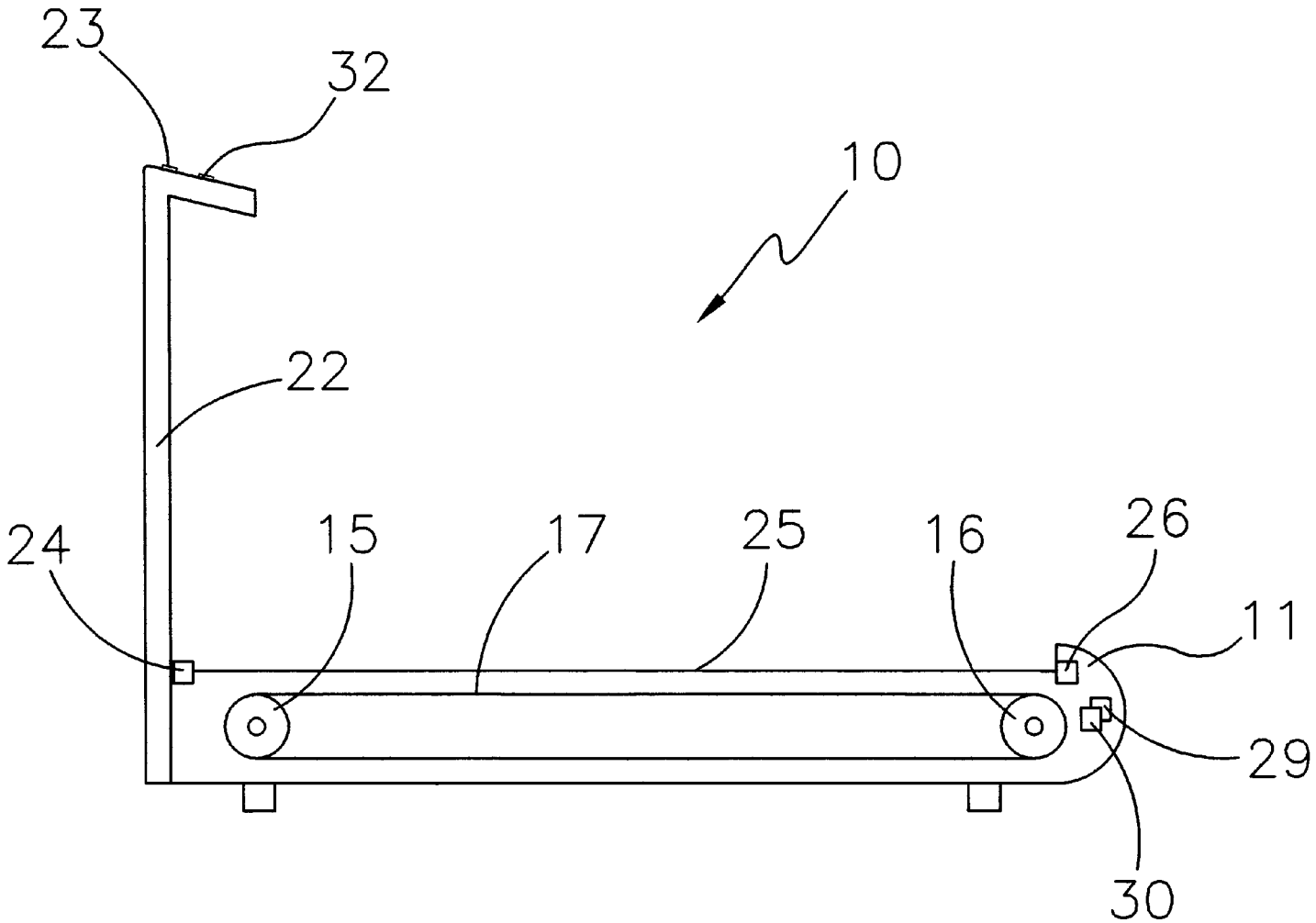
FIG. 3 is a cross-sectional view of the present invention.
Figure 4:
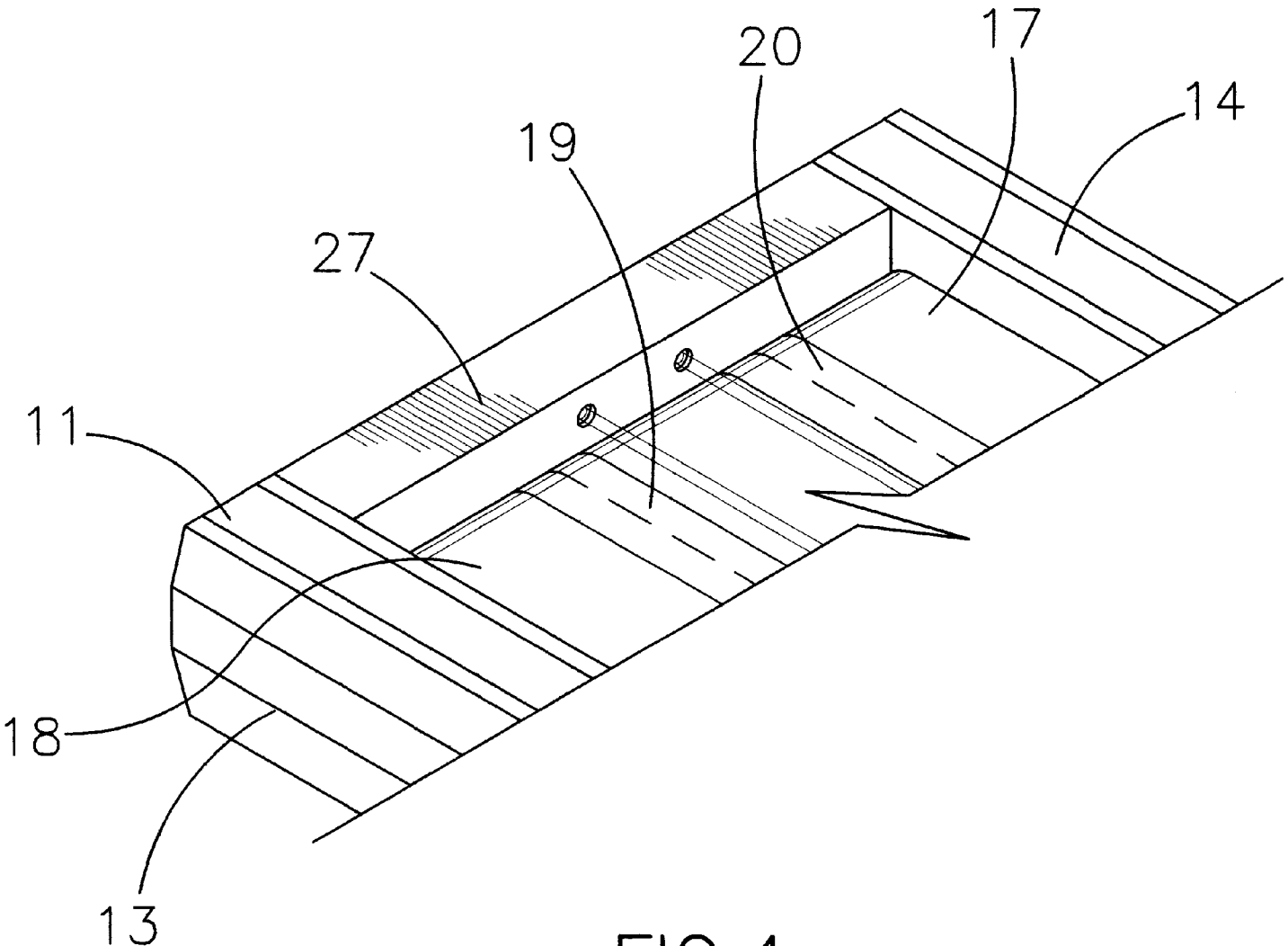
FIG. 4 is a partial perspective view of the present invention
Figure 5:
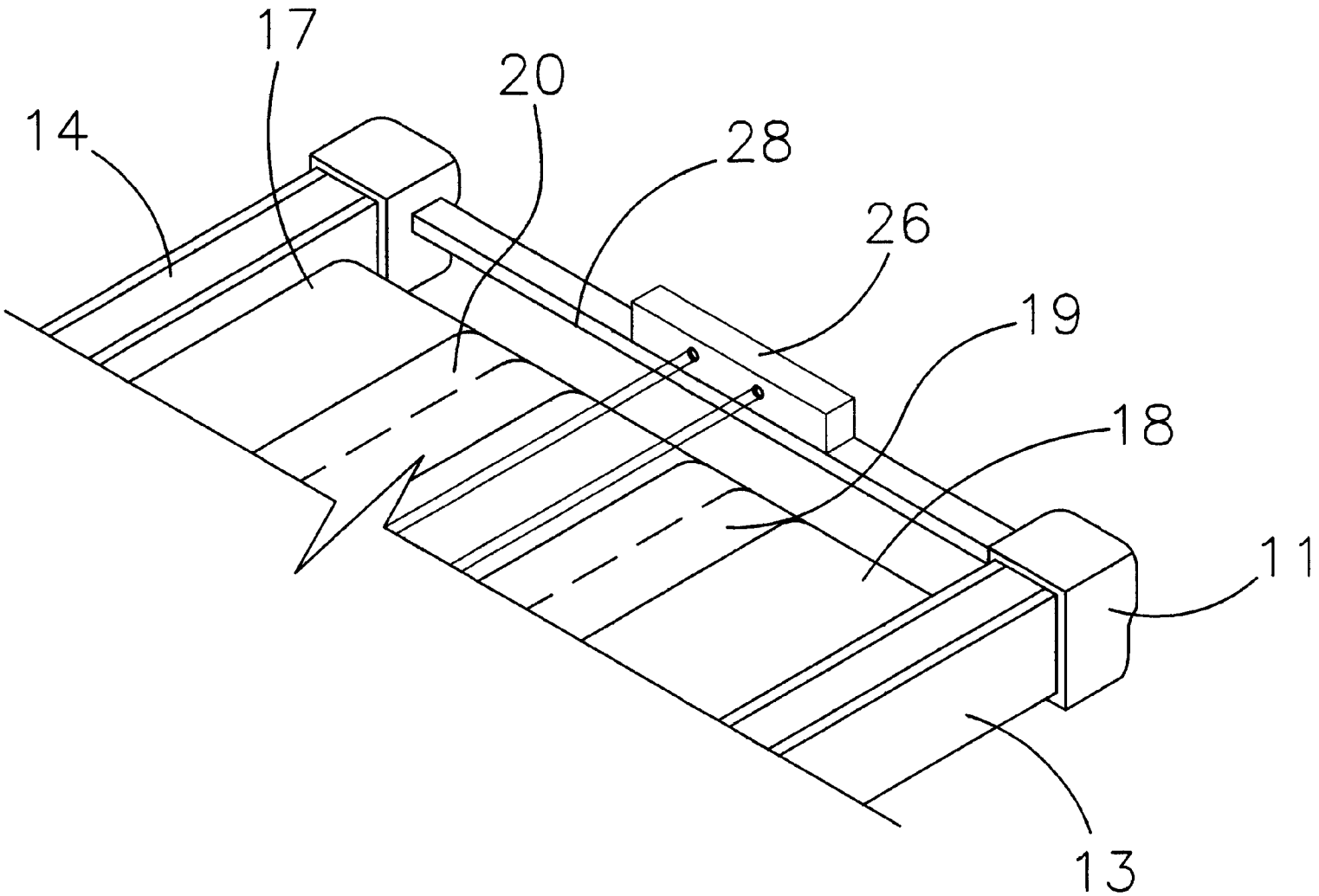
FIG. 5 is yet another partial perspective view of the present invention.

With reference now to the drawings, and in particular to FIGS. 1 through 5 thereof, a new foot straightening trainer apparatus embodying the principles and concepts of the present invention and generally designated by the reference numeral 10 will be described.

As best illustrated in FIGS. 1 through 5, the foot straightening trainer apparatus 10 generally comprises a base assembly including an elongate housing 11 having top and side walls 12–14, and also includes rollers 15,16 being spaced apart and being conventionally disposed in the elongate housing 11, and further includes an endless belt 17 having a selected width and being conventionally carried about the rollers 15,16 and being movable upon the top wall 12, and also having a motor 21 being conventionally connected to one of the rollers 15,16, and further having a power cord 31 being conventionally attached to the motor 21. The endless belt 17 includes designated, longitudinally-oriented left and right walkways 19,20 being conventionally disposed and outlined upon the outer side 18 thereof. The left and right walkways 19,20 are laterally spaced apart and have widths and boundaries to completely support the feet of the user within the boundaries when the user's feet are directed and pointed parallel to the left and right walkways 19,20.

A handrail assembly 22 is conventionally attached to the elongate housing 11 and extends upwardly therefrom for a user to hold while walking upon the endless belt 17. A first switch member 23 is conventionally attached to the handrail assembly 22 for energizing the motor 21 to drive the endless belt 17.

A sensor/alarm assembly for detecting improper foot alignment and for signaling to the user of the detection of the improper foot alignment includes four conventionally light-emitting members 24, preferably infra-red producing member, being conventionally attached at a first end 27 of the elongate housing 11 and being arranged to direct beams of light 25 lengthwise along and above the endless belt 17. The sensor/alarm assembly also includes four conventional light-receiving sensors 26 being securely and conventionally attached at a second end 28 of the elongate housing 11 and being aligned with the light-emitting members 24 to receive and detect the beams of light 25 from the light-emitting members 24. The sensor/alarm assembly also includes a sound-producing member 29 such as a conventional buzzer alarm being conventionally mounted to the elongate housing 11, and further includes a conventional relay 30 being conventionally attached to the sound-producing member 29 and being conventionally connected to the light-receiving sensors 26. The sensor/alarm assembly also includes a second switch member 32 being conventionally connected to the light-emitting members 24, and to the light-receiving sensors 26, and to the sound-producing member 29, and to the power cord 31 for energizing the light-emitting members 24, the light-receiving sensors 26, and the sound-producing member 29. The light-emitting members 24 and the light-receiving sensors 26 are positioned such that beams of light 25 are directed along longitudinal edges of the left and right walkways 19,20 such that the sound-producing member 29 is energized upon the user crossing into a path of any of the beams of light 25 thus letting the user know to straighten one's feet while walking on the endless belt 17.

In use, the user turns on the first switch member 23 to energize the motor 21 which actuates the movement of the endless belt 17, and then turns on the second switch member 32 to actuate the light-emitting members 24, the light-receiving sensors 26, and the sound-producing member 29. As the user walks upon the designated left and right walkways 19, 20 upon the endless belt 17, each time at least one of the user's feet crosses any of the beams of light 25, the sound-producing member 29 will emit an audible sound to let the user know that he/she needs to correct the alignment of one's feet while walking upon the endless belt 17. Once the user removes, the foot or feet causing the alarm, the sound-producing member 29 will be deactivated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the foot straightening trainer apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot straightening trainer apparatus comprising:

a base assembly including an elongate housing having top and side walls, and also including rollers being spaced apart and being disposed in said elongate housing, and further including an endless belt having a selected width and being carried about said rollers and being movable upon said top wall, and also having a motor being connected to at least one of said rollers, and further having a power cord conventionally connected to said motor;

a handrail assembly being attached to said elongate housing and extending upwardly therefrom for a user to hold while walking upon said endless belt;

a first switch member being attached to said handrail assembly for energizing said motor to drive said endless belt; and a sensor/alarm assembly for detecting improper foot alignment and for signaling to the user of the detection.

2. A foot alignment trainer apparatus as described in claim 1, wherein said endless belt includes designated, longitudinally-oriented left and right walkways being disposed thereupon, said left and right walkways being laterally spaced apart and having widths and boundaries to completely support the feet of the user within the boundaries when the user's feet are directed and pointed parallel to said left and right walkways.

3. A foot alignment trainer apparatus as described in claim 2, wherein said sensor/alarm assembly includes light-emitting members being attached at a first end of said elongate housing and being arranged to direct beams of light lengthwise along and above said endless belt.

4. A foot alignment trainer apparatus as described in claim 3, wherein said sensor/alarm assembly also includes light-receiving sensors being securely attached at a second end of said elongate housing and being aligned with said light-emitting members to receive and detect the beams of light from said light-emitting members.

5. A foot alignment trainer apparatus as described in claim 4, wherein said sensor/alarm assembly also includes a sound-producing member mounted to said elongate housing, and further includes a relay being attached to said sound-emitting member and being connected to said light-receiving sensors.

6. A foot alignment trainer apparatus as described in claim 5, wherein said sensor/alarm assembly also includes a second switch member being connected to said light-emitting members, and to said light-receiving sensors, and to said sound-producing member, and to said power cord for energizing said light-emitting members, light-receiving sensors, and said sound-producing member.

7. A foot alignment trainer apparatus as described in claim 6, wherein said light-emitting members and said light-receiving sensors are positioned such that beams of light are directed along longitudinal edges of said left and right walkways such that said sound-producing member is energized upon the user crossing into a path of any of said beams of light thus letting the user know to straighten one's feet while walking on said endless belt.

* * * * *